US005290648A

United States Patent [19]

Kim et al.

[11] Patent Number: 5,290,648

[45] Date of Patent: Mar. 1, 1994

[54] METHOD FOR MANUFACTURING A SCREEN FOR A CATHODE RAY TUBE

[75] Inventors: Min-ho Kim; Ik-cheol Lim, both of Kyungki-do, Rep. of Korea

[73] Assignee: Samsung Electron Devices Co., Ltd., Kyungki-do, Rep. of Korea

[21] Appl. No.: 921,222

[22] Filed: Jul. 29, 1992

[30] Foreign Application Priority Data

Oct. 17, 1991 [KR] Rep. of Korea ..... 91-18313

[51] Int. Cl.[5] ..... G03C 5/00

[52] U.S. Cl. ..... 430/28; 430/23

[58] Field of Search ..... 430/23, 25, 26, 28, 430/321

[56] References Cited

U.S. PATENT DOCUMENTS 2,837,429 6/1958 Whiting ..... 430/28

4,612,268 9/1986 Miura et al. ..... 430/23

*Primary Examiner*—Marion E. McCamish

*Assistant Examiner*—S. Rosasco

*Attorney, Agent, or Firm*—Leydig, Voit & Mayer

[57] ABSTRACT

A method for manufacturing a screen for a cathode ray tube is provided comprising the steps of forming a first phosphor layer through coating a phosphor slurry containing a first phosphor, polyvinyl alcohol having a polymerization degree of 1,500 to 2,000 and distilled water on the inner surface of a panel, drying, exposing and developing the first phosphor layer, and then forming a second phosphor layer through coating a phosphor slurry containing a second phosphor, polyvinyl alcohol having a polymerization degree of 1,500 to 2,000 and distilled water on the surface of the first phosphor layer, drying, exposing and developing the second phosphor layer; wetting the surface of the first and second phosphor layers with distilled water; and forming a third phosphor layer through coating a phosphor slurry containing a third phosphor, polyvinyl alcohol having a polymerization degree of 500 to 600 and distilled water on the surface of the first and second phosphor layers, drying, exposing and developing the third phosphor layer.

10 Claims, 1 Drawing Sheet

METHOD FOR MANUFACTURING A SCREEN FOR A CATHODE RAY TUBE

BACKGROUND OF THE INVENTION

The present invention relates to a method for manufacturing a screen for a cathode ray tube, and particularly to a method for manufacturing a screen for a cathode ray tube in which emitting luminance is enhanced through enhancing the smoothness and compactness of the screen.

Generally, a screen, called a phosphor layer, for a cathode ray tube is manufactured through coating a slurry containing red, green or blue emitting phosphors on the inner surface of a panel, carrying out drying, exposing and developing processes, and then coating the remaining two phosphors in a predetermined dot or stripe pattern and in the same manner as described above. A thin aluminium layer is formed at a predetermined distance from the surface of the thus-obtained screen.

The prior art pattern-forming process of the phosphor layer will be described in detail with reference to the attached FIGS. 1A–1C.

Phosphor slurry is prepared by dispersing phosphors in a mixture of polyvinyl alcohol having a polymerization degree of 1,500 to 2,000 and a saponification degree of 80 to 90 mol % and, playing the role of attaching the phosphor onto the panel surface, a photosensitive sodium dichromate, a surfactant which facilitates the mixing of water with organic materials, an acryl emulsion and distilled water. Generally, the specific gravity of the thus-obtained phosphor slurry ranges from 1.280 to 1.299, with its viscosity ranging from 31 to 45 cps.

A phosphor slurry prepared by dispersing the first phosphor, for example, a green phosphor slurry prepared by dispersing green emitting phosphors is coated on the inner surface of the panel (1), on the upper surface of the black matrix (2) and dried to give a photosensitive layer. The prescribed parts of the layer are exposed to ultraviolet light using a shadow mask. At this time, the difference of solubility in water between the exposed parts and un-exposed parts of the photosensitive layer, comes into play. Through the developing process afterward, water soluble parts are dissolved out and water resist parts remain on the surface of the panel (1) to form the first phosphor layer, for example, a green emitting phosphor layer (FIG. 1A). Following the same method as described above, the second and third phosphor layers, for example, blue (FIG. 1B) and red (FIG. 1C) emitting phosphor layers, are formed to complete the phosphor pattern of each color.

According to the above-mentioned method, the first phosphor layer is stable, however, the dot (or stripe) in the second phosphor layer accumulates to the first phosphor as illustrated in FIG. 1B, and in the third layer, correspondingly accumulates and leans toward the pre-formed first and second phosphor as illustrated in FIG. 1C. This attraction is based on moisture absorption by pre-formed layer(s). For the second phosphor, during the drying process after coating the second phosphor slurry, absorption of the moisture from the second phosphor slurry by the pre-formed first phosphor layer results in the inclination of the second phosphor toward the first phosphor side. For the third phosphor, during the drying process after coating the third phosphor slurry, absorption of the moisture from the third phosphor slurry by the pre-formed first and second phosphor layers also results in the inclination of the third phosphor toward the first and second phosphor layers and this gives a dot (or stripe) of the third phosphor having a thick periphery and a relatively thin center. Consequently, the prior art process does not provide a smooth phosphor layer and may cause hole-perforation, especially in the third phosphor layer. The uneven phosphor layer deteriorates the smoothness of an aluminium layer manufactured through the subsequent filming layer manufacturing process, aluminium deposition process and baking process. The deterioration of the smoothness of the aluminium layer means the deterioration of the ratio of mirror reflection of the layer. This ultimately results in the deterioration of emission luminance of the phosphor layer.

SUMMARY OF THE INVENTION

An object of the invention is to provide a method for manufacturing a screen for a cathode ray tube in which the emission luminance is enhanced through improving the smoothness and compactness of the phosphor layer by changing the component of the third phosphor slurry and improving the coating process of the phosphor slurry.

To accomplish the above-mentioned object, there is provided in the present invention, a method for manufacturing a screen for a cathode ray tube comprising the steps of: forming a first phosphor layer through coating a phosphor slurry containing the first phosphor, polyvinyl alcohol having a polymerization degree of 1,500 to 2,000 and distilled water on the inner surface of the panel, and the drying, exposing and developing thereof, and then forming a second phosphor layer through coating a phosphor slurry containing the second phosphor, polyvinyl alcohol having a polymerization degree of 1,500 to 2,000 and distilled water on the surface of the first phosphor layer, and the drying, exposing and developing thereof; wetting the surface of the first and second phosphor layers with distilled water; and forming the third phosphor layer through coating a phosphor slurry containing the third phosphor, polyvinyl alcohol having a polymerization degree of 500 to 600 and distilled water on the surface of the first and second phosphor layers, and the drying, exposing and developing thereof.

In particular, the saponification degree of the polyvinyl alcohol having the polymerization degree of 500 to 600 preferably ranges from 85 to 90 mol %. Wetting the surface of the first and second phosphor layers with warm water (40° C.) will give a very smooth phosphor layer, preventing the absorption of the moisture from the third phosphor slurry.

The viscosity of the third phosphor slurry is 8 to 12 cps lower and the specific gravity 0.2 to 0.4 higher, than those properties of the first and second phosphor slurries.

DETAILED DESCRIPTION OF THE INVENTION

The method for manufacturing a screen for a color cathode ray tube of the present invention will be described with reference to the preferred embodiments in detail below.

EXAMPLE

First, 1.1 kg of 8% polyvinyl alcohol (Junsei Chemical Co.) having a polymerization degree of 1,900 and a saponification degree of 86.5-90 mol %, 0.06 kg of sodium dichromate, 1.3 kg of distilled water and 17 g of anionic surfactant (Sigma Chemical Co.) are mixed. Then, 1 kg of ZnS:Cu,Au,Al green emitting phosphor is added to the prepared mixture and stirred to prepare a green phosphor slurry. Coating the slurry on the inner surface of the panel on which a black matrix layer is formed, and the subsequent drying, exposing and developing thereof gives a green phosphor layer.

Next, 1.1 kg of 8% polyvinyl alcohol (Junsei Chemical Co.) having a polymerization degree of 1,900 and a saponification degree of 86.5-90 mol %, 0.06 kg of sodium dichromate, 1.3 kg of distilled water and 17 g of anionic surfactant (Sigma Chemical Co.) are mixed. 1 kg of ZnS:Ag blue emitting phosphor is added to the prepared mixture, and stirred to prepare a blue phosphor slurry. Coating the slurry on the surface of the green phosphor layer and the subsequent drying, exposing and developing thereof gives a blue phosphor layer.

Before coating the third phosphor slurry, the surface of the green and blue phosphor layer is sprayed with water being of 40° C., to wet the phosphor layer.

Figure 2:
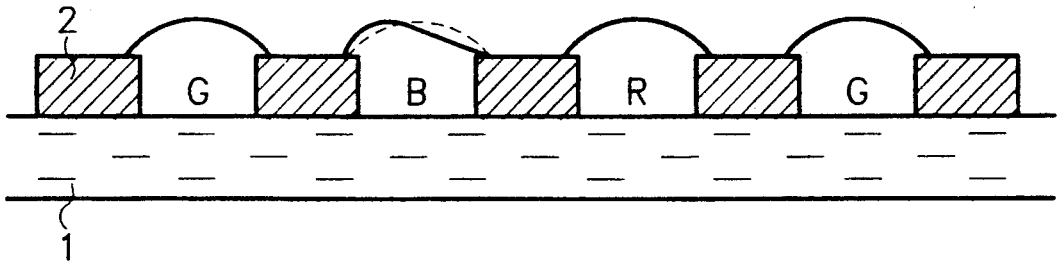
FIG. 2 illustrates the phosphor pattern manufactured by the method of the present invention.

Then, 1.3 kg of 8% polyvinyl alcohol (Junsei Chemical Co.) having a polymerization degree of 500 and a saponification degree of 86.5-90 mol %, 0.06 kg of sodium dichromate, 1.3 kg of distilled water and 17 g of anionic surfactant (Sigma Chemical Co.) are mixed. Then 1 kg of $Y_2O_2S$:Eu red emitting phosphor is added to the mixture, and stirred to prepare a red phosphor slurry. At this time, the viscosity of the red phosphor slurry is about 10 cps lower than those of the green and blue phosphor slurries (which are about 30 to 45 cps), and the specific gravity of the red phosphor slurry is higher than those of the green and blue phosphor slurries (about 1.280 to 1.290). Coating the slurry on the upper part of the wet green and blue phosphor layers, and the subsequent drying, exposing and developing thereof gives a red phosphor layer. Now, a screen having each patterned color of the phosphor layer according to the present invention is prepared. The thus-obtained phosphor layer is illustrated in FIG. 2.

COMPARATIVE EXAMPLE

Figure 1A:
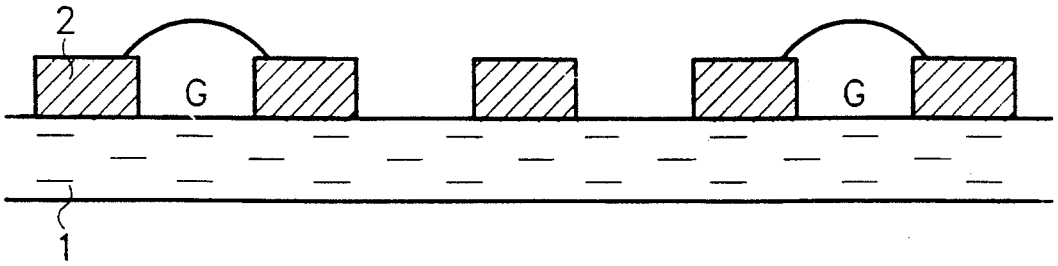
FIG.1A(PRIOR ART)
FIGS. 1A, 1B and 1C illustrate a process for manufacturing each color pattern of phosphor layers according to the conventional method, in which FIG. 1A corresponds to a first phosphor layer (G), FIG. 1B, a second phosphor layer (B) and FIG. 1C, a third phosphor layer (R), respectively.
Figure 1B:
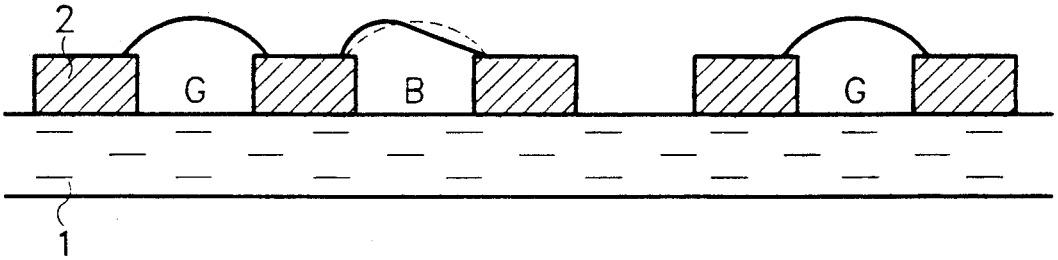
FIG.1B(PRIOR ART)
Figure 1C:
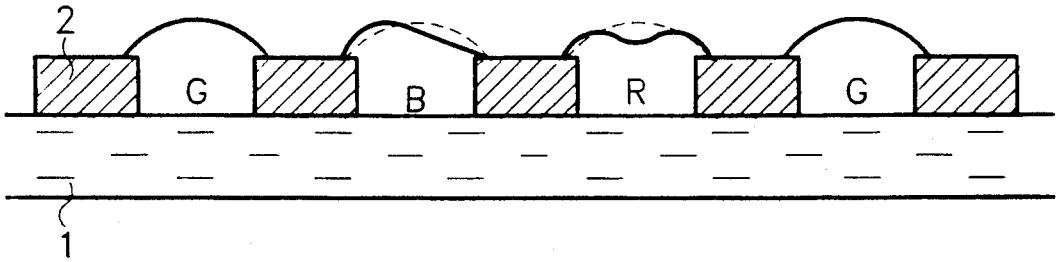
FIG.1C(PRIOR ART)

Green and blue phosphor layers are formed in the same manner as described in the above example. A red phosphor layer is formed by employing the red phosphor slurry obtained by mixing $Y_2O_2S$:Eu red emitting phosphors with the same slurry mixture as that used for the green and blue phosphor slurries. The thus-obtained phosphor layer is illustrated in FIG. 1C.

The respective emission luminances of each color phosphor layer manufactured by the conventional method using phosphor slurries of each color, and those of the phosphor layer manufactured by the method of the present invention employing the steps of wetting the phosphor layer, after forming the second phosphor layer and using a third phosphor slurry including different component than the first and second phosphor slurries, are illustrated in Table 1. (In Table 1, the emission luminances were detected by means of MECC system.)

TABLE 1

| | comparative example (f/L) | example (f/L) | increase (f/L) |
|---|---|---|---|
| green emitting phosphor | 99.6 | 104 | 4.4 |
| blue emitting phosphor | 17.2 | 18.4 | 7.0 |
| red emitting phosphor | 29.8 | 32.5 | 9.1 |

As shown in Table 1, the luminances of the phosphor layer manufactured by the method of the present invention is increased by 4 to 10%, when compared with that of the conventional phosphor layer. This high emission luminance of the phosphor layer of the present invention is achieved through the following mechanism.

First, since the third phosphor slurry is prepared by employing a polyvinyl alcohol having the low polymerization degree of 500 to 600, it has a lower viscosity and higher specific gravity than the conventional slurry prepared by employing a polyvinyl alcohol having the polymerization degree of 1,500 to 2,000. Generally, a slurry of lower viscosity provides a compact phosphor layer having fewer stains, and a slurry of high specific gravity results in the rapid settlement of phosphor particles in the slurry. Therefore, the thus-obtained third phosphor layer manufactured by using third phosphor slurry having a low viscosity and high specific gravity according to the method of the present invention, has good compact density.

However, the slurry prepared by using the low-polymerization polyvinyl alcohol which has such good characteristics, cannot be used with the first and second phosphor slurries because it has low adhesive strength. If the slurry including low-polymerization polyvinyl alcohol is used to manufacture the first and second phosphor layers, the dot (or stripe) of the phosphor layer will eventually detach from the layer, or crack after two or three developing processes.

Moreover, in the method of the present invention, the wetting of the surface of the pre-formed first and second phosphor layers before coating the third phosphor slurry, gives first and second phosphor layers which contain a great deal of water. Therefore, the first, two phosphor layers may not absorb water from the third phosphor slurry during its drying process. This produces a third phosphor layer in which the dots (or stripes) are smoothly coated without being drawn toward the first and second phosphor dots as shown in FIG. 2.

A screen manufactured by the method of the present invention has a uniform third phosphor layer, which enhances the smoothness and the emission luminance of the screen.

What is claimed is:

1. A method for manufacturing a screen for a cathode ray tube comprising the steps of:

forming a first phosphor layer through coating a phosphor slurry containing a first phosphor, polyvinyl alcohol having a polymerization degree of 1,500 to 2,000 and distilled water on he inner surface of a panel, drying, exposing and developing the first phosphor layer, and then forming a second phosphor layer through coating a phosphor slurry containing a second phosphor, polyvinyl alcohol having a polymerization degree of 1,500 to 2,000 and distilled water on the surface of said first phosphor layer, drying, exposing and developing the second phosphor layer;

wetting the surface of said first and second phosphor layers with distilled water; and forming a third phosphor layer through coating a phosphor slurry containing the third phosphor, polyvinyl alcohol having a polymerization degree of 500 to 600 and distilled water on the surface of said first and second phosphor layers, drying, exposing and developing the third phosphor layer.

2. A method for manufacturing a screen for a cathode ray tube as claimed in claim 1, wherein the temperature of said distilled water for wetting said first and second phosphor layers is 40° C.

3. A method for manufacturing a screen for a cathode ray tube as claimed in claim 1, wherein the viscosity of said third phosphor slurry is lower, and the specific gravity higher than those properties of said first and second phosphor slurries.

4. A method for manufacturing a screen for a cathode ray tube as claimed in claim 3 wherein the viscosity of said third phosphor slurry is 8 to 12 cps lower than that of said first and second phosphor slurries.

5. A method for manufacturing a screen for a cathode ray tube as claimed in claim 3 wherein the specific gravity of said third phosphor slurry is 0.2 to 0.4 higher than that of said first and second phosphor slurries.

6. A method for manufacturing a screen for a cathode ray tube as claimed in claim 1 wherein the saponification degree of the polyvinyl alcohol in the phosphor slurries used in forming the first phosphor layer and the second phosphor layer is about 86.5 to 90.0 mole percent.

7. A method for manufacturing a screen for a cathode ray tube as claimed in claim 1 wherein the specific gravity of the phosphor slurries of the first phosphor and second phosphor are about 1.280 to about 1.290.

8. A method for manufacturing a screen for a cathode ray tube as claimed in claim 1 wherein the viscosity of the slurries of the first phosphor and of the second phosphor are about 30 to about 45 cps.

9. A method for manufacturing a screen for a cathode ray tube as claimed in claim 1 wherein each of the phosphor slurries contains sodium dichromate.

10. A method for manufacturing a screen for a cathode ray tube as claimed in claim 1 wherein each of said phosphor slurries contains an anionic surfactant.

* * * * *